United States Patent [19]

Morrison

[11] Patent Number: 4,572,546

[45] Date of Patent: Feb. 25, 1986

[54] BOOKPIN

[76] Inventor: Joseph A. Morrison, 8070 Craig St., Philadelphia, Pa. 19136

[21] Appl. No.: 545,441

[22] Filed: Oct. 26, 1983

[51] Int. Cl.[4] ..... B42D 9/00

[52] U.S. Cl. ..... 281/42; 281/45

[58] Field of Search ..... 281/42, 45; 24/67.3, 24/67.9, 150 B, 153

[56] References Cited

U.S. PATENT DOCUMENTS

| | | | |
|---|---|---|---|
| 309,777 | 12/1884 | Flint | 281/42 |
| 432,038 | 7/1890 | Harding | 281/42 |
| 700,453 | 5/1902 | Thomas | 281/42 |
| 1,579,438 | 4/1926 | Cortelyou | 281/42 |
| 2,606,042 | 8/1952 | Freber | 281/42 |
| 3,661,405 | 9/1972 | Brown | 281/42 |
| 3,986,232 | 10/1976 | Teetor | 281/45 X |
| 4,474,383 | 10/1984 | Kikis | 281/45 X |

FOREIGN PATENT DOCUMENTS

| | | | |
|---|---|---|---|
| 1144205 | 4/1983 | Canada | 281/45 |

*Primary Examiner*—Paul A. Bell
*Assistant Examiner*—Taylor J. Ross
*Attorney, Agent, or Firm*—John F. A. Earley; John F. A. Early, III

[57] ABSTRACT

A bookpin for clamping onto an open book and holding the pages flat for reading without using the hands comprises a front hold down arm having a free end and a hinge end, a rear hold down arm having a free end and a hinge end, a hinge portion connecting the hinge ends together to urge the front and rear arms together so as to clamp onto an open book and hold it flat for reading, the front hold down arm being made of a clear see-through material so a reader can read through it, the free ends forming an open end of the pin for slipping it over the book, the hinge ends forming a closed end of the bookpin, and the free end of each arm having an outwardly flared portion for more easily slipping the bookpin onto the book.

3 Claims, 2 Drawing Figures

BOOKPIN

FIELD OF THE INVENTION

This invention relates to the field of devices for holding and reading books, and more particularly concerns a device for holding a book open for reading without being required to use the hands.

BACKGROUND OF THE INVENTION

It has been a problem on the beach at the seashore to hold a book open and flat for reading on a windy day because the wind keeps ripping at the pages and making them flutter.

It has also been a problem to hold open a book when the reader is required to use his hands for other things, such as cooking or typing.

In general, it has been a problem to read comfortably without the hands to hold the book, and to hold the pages when necessary.

It is an object of this invention to provide a device that holds a book in open position, and holds down the pages for easy reading, without requiring the use of the hands. It is also an object to provide such a device that may be used as a book marker, and which keeps your place if you should fall asleep and drop the book.

It is another object to provide a device which makes it easier to hold the book with one hand while reading, such as while reading in bed, on public transportation, while sitting, or while standing.

It is another object to provide a device that holds technical books, cook books, and the like, open while the reader is working with his hands and reading from the book, such as while typing or while cooking.

It is another object to provide a device that is adapted for no-hand windy day reading on the beach at the seashore or elsewhere.

DETAILED DESCRIPTION OF THE INVENTION

Figure 1:
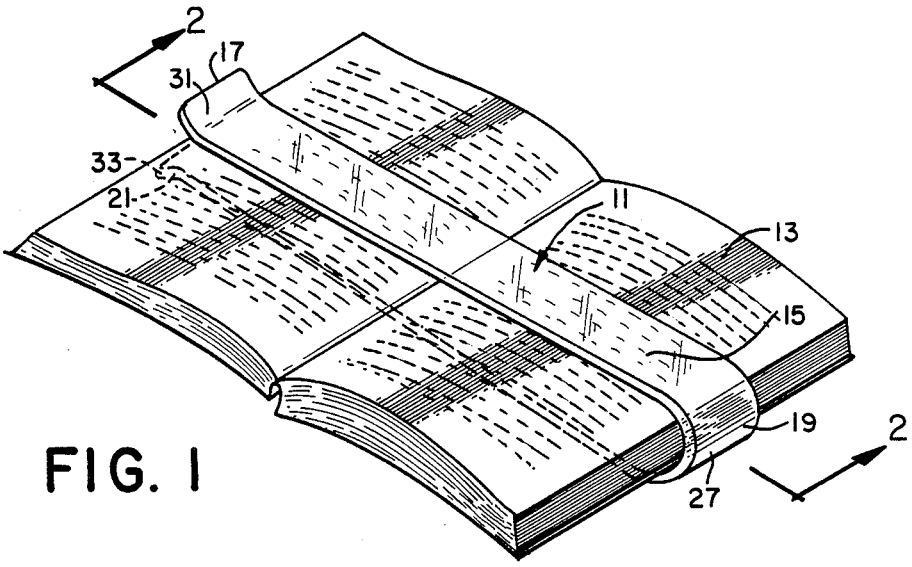
FIG. 1 shows a view in perspective of a bookpin constructed in accordance with this invention and mounted in operative position on a book.
Figure 2:
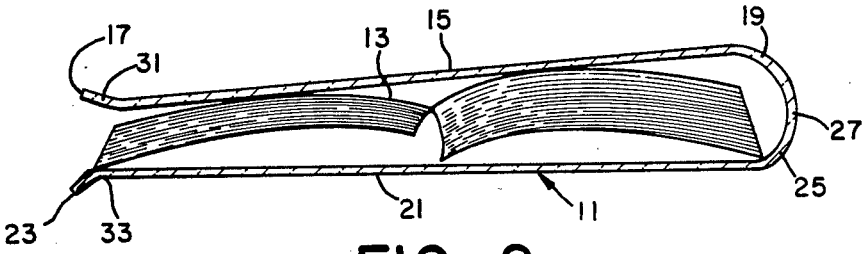
FIG. 2 shows a view in section taken as indicated by lines and arrows 2—2 in FIG. 1.

Turning now to the drawings, there is shown a bookpin 11 mounted on an opened book 13 and clamping the book open and holding the pages flat for easy reading. Bookpin 11 comprises a front hold down arm 15 having a free end 17 and a hinge end 19, a rear hold down arm 21 having a free end 23 and a hinge end 25, and a hinge portion 27 connecting the hinge ends 19, 25 to urge the front and rear arms 15, 21 together so as to clamp onto the open book 13 and hold it flat for reading.

The front hold down arm 15 is made of a clear see-through plastic material so that a reader can read through it.

The free ends 17, 23 form an open end of the bookpin 11 for slipping it easily over the book 13, and the hinge portion 27 forms a closed end of the bookpin 11.

The free end 17 of front hold down arm 15 is provided with an outwardly flared portion 31, and the free end 23 of rear hold down arm 21 is also provided with an outwardly flared portion 33. The outwardly flared portions 31, 33 provide for more easily slipping the bookpin 11 onto the open book 13.

The rear hold down arm 21 may be made of a clear see-through plastic material so that the book-pin is reversible, and the rear arm 21 can be positioned in front of the page and the reader can read through it.

Bookpin 11 makes it more comfortable to hold and read paperback books, especially, and all books.

The preferred material for the bookpin 11 is a synthetic plastic material because you can see through it and it does not easily break or chip.

The inventive bookpin allows the user to place the book on the ground or on a table, or on the beach, and so on, and read while the pages are held in a position that enables him to lie down, sit down, or sprawl, and still read comfortably without having to hold the book or to hold the pages down.

Bookpin 11 eliminates the need to hold the book tightly so that the pages are flat and readable. Bookpin 11 enables the reader to hold the book lightly and comfortably and allow bookpin 11 to do the work.

Bookpin 11 makes a good bookmarker, and keeps the reader's place if he should fall asleep and drop the book while reading.

Bookpin 11 allows for easier one-hand holding while reading anywhere, as in bed, on public transportation, in sitting or standing position, or while sprawled on the floor, on a couch, or in bed.

Bookpin 11 can be utilized to hold technical books, cookbooks, and the like, in open position while the reader is working from them and using his hands for typing or writing.

Bookpin 11 provides for easy no-hand windy-day reading.

Bookpin 11 may be provided in different sizes, with different arm lengths for regular books, paperback books, and so on.

I claim:

1. A bookpin for clamping onto an open book and holding the pages flat for reading, comprising a front hold down arm having a predetermined length and having a free end and a hinge end, a rear hold down arm having substantially the same length and having a free end and a hinge end, and hinge means connecting the hinge ends to urge the front and rear arms together so as to clamp onto an open book and hold it flat for reading, said front hold down arm being made of a clear see-through material so a reader can read through it, said free ends forming an open end of the bookpin for slipping it over the book, said hinge means forming a closed end of the bookpin, said bookpin having a one-piece construction.

2. The bookpin of claim 1, the free end of each arm having an outwardly flared portion for more easily slipping the bookpin onto the book.

3. The bookpin of claim 1, said rear hold down arm being made of clear see-through material so that the bookpin is reversible and the rear arm can be positioned in front of the page.

* * * * *